United States Patent [19]

Steinberger

[11] Patent Number: 4,915,006

[45] Date of Patent: Apr. 10, 1990

[54] SUPPORT FOR DEFINING AN END POINT OF THE VIBRATING PORTION OF THE STRINGS OF A STRINGED MUSICAL INSTRUMENT

[75] Inventor: Ned Steinberger, New Windsor, N.Y.

[73] Assignee: Steinberger Sound Corporation, Newburgh, N.Y.

[21] Appl. No.: 310,795

[22] Filed: Jan. 18, 1989

[51] Int. Cl.[4] ..... G10D 3/06

[52] U.S. Cl. ..... 84/314 N

[58] Field of Search ..... 84/298, 299, 313, 314 N, 84/307

[56] References Cited

U.S. PATENT DOCUMENTS

| | | | |
|---|---|---|---|
| 2,247,565 | 7/1941 | Wagner | 84/299 |
| 2,489,657 | 11/1949 | McBride | 84/317 |
| 2,905,042 | 9/1959 | Hoyer | 84/298 |
| 3,181,409 | 5/1965 | Burns et al. | 84/313 |
| 3,237,502 | 3/1966 | Moseley | 84/298 |
| 3,411,394 | 11/1968 | Jones | 84/313 |
| 3,439,571 | 4/1969 | Ryan | 84/307 X |
| 3,443,467 | 5/1969 | Richards | 84/307 X |
| 4,563,934 | 1/1986 | Keizer | 84/313 |

*Primary Examiner*—Michael L. Gellner
*Assistant Examiner*—Brian W. Brown
*Attorney, Agent, or Firm*—Finnegan, Henderson, Farabow, Garrett & Dunner

[57] ABSTRACT

A support for defining an end point of the vibrating portion of the strings of a stringed musical instrument comprises a base having a slot with walls which converge to an apex line. At least one rocker has walls which converge to a knife edge complementary to the apex line, where the angle between the walls of the base is larger than the angle between the walls of the rocker to allow the rocker to rock in the slot while the knife edge engages the apex line. The rocker has an arc-shaped surface centered at the knife edge for contacting at least one of the strings and moving with the string in a direction along the length of the string while maintaining the end point of the vibrating position of the string at a constant position relative to the base in the direction along the length of the string.

16 Claims, 2 Drawing Sheets

10
12
14
16
18
20
22
24
26
28
30
32
34
36
38

3
3
12
14
18
20
30
32
34
38

SUPPORT FOR DEFINING AN END POINT OF THE VIBRATING PORTION OF THE STRINGS OF A STRINGED MUSICAL INSTRUMENT

BACKGROUND OF THE INVENTION

1. Field of the Invention

The present invention relates to a support for defining an end point of the vibrating portion of the strings of a stringed musical instrument.

2. Description of the Related Art

Many present day guitars and similar stringed instruments are equipped with a tremolo. The musician, by manual manipulation of the tremolo, can control the pitch of the instrument. However, difficulties have been encountered in the past in controlling the pitch of the strings both during and after tremolo operation.

By actuating a tremolo lever, the strings of a guitar slide over the bridge and nut of the guitar. When the tremolo lever is released, the strings slide back toward their original positions. However, due to friction, the strings do not completely return to their original positions relative to the bridge and nut.

Accordingly, it is an object of the present invention to provide a device for allowing the strings to return to their original position relative to the bridge and nut after the tremelo has been actuated and released.

It is a further object of the invention to provide a device for allowing the strings to return to their original position which exhibits low friction.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purposes of the invention as embodied and broadly described herein, there is provided a support for defining an end point of the vibrating portion of the strings of a stringed musical instrument. The support comprises a base having a slot with walls which converge to an apex line. The support further comprises at least one rocker having walls which converge to a knife edge complementary to the apex line, where the angle between the walls of the base is larger than the angle between the walls of the rocker to allow the rocker to rock in the slot while the knife edge engages the apex line. The rocker has contacting means for contacting at least one string and moving with the string in a direction along the length of the string while maintaining the end point of the vibrating portion of the string at a constant position relative to the base in the direction along the length of the string.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

DESCRIPTION OF THE PREFERRED EMBODIMENTS

Reference will now be made in detail to the present preferred embodiment of the invention as illustrated in the accompanying drawings.

Figure 1:
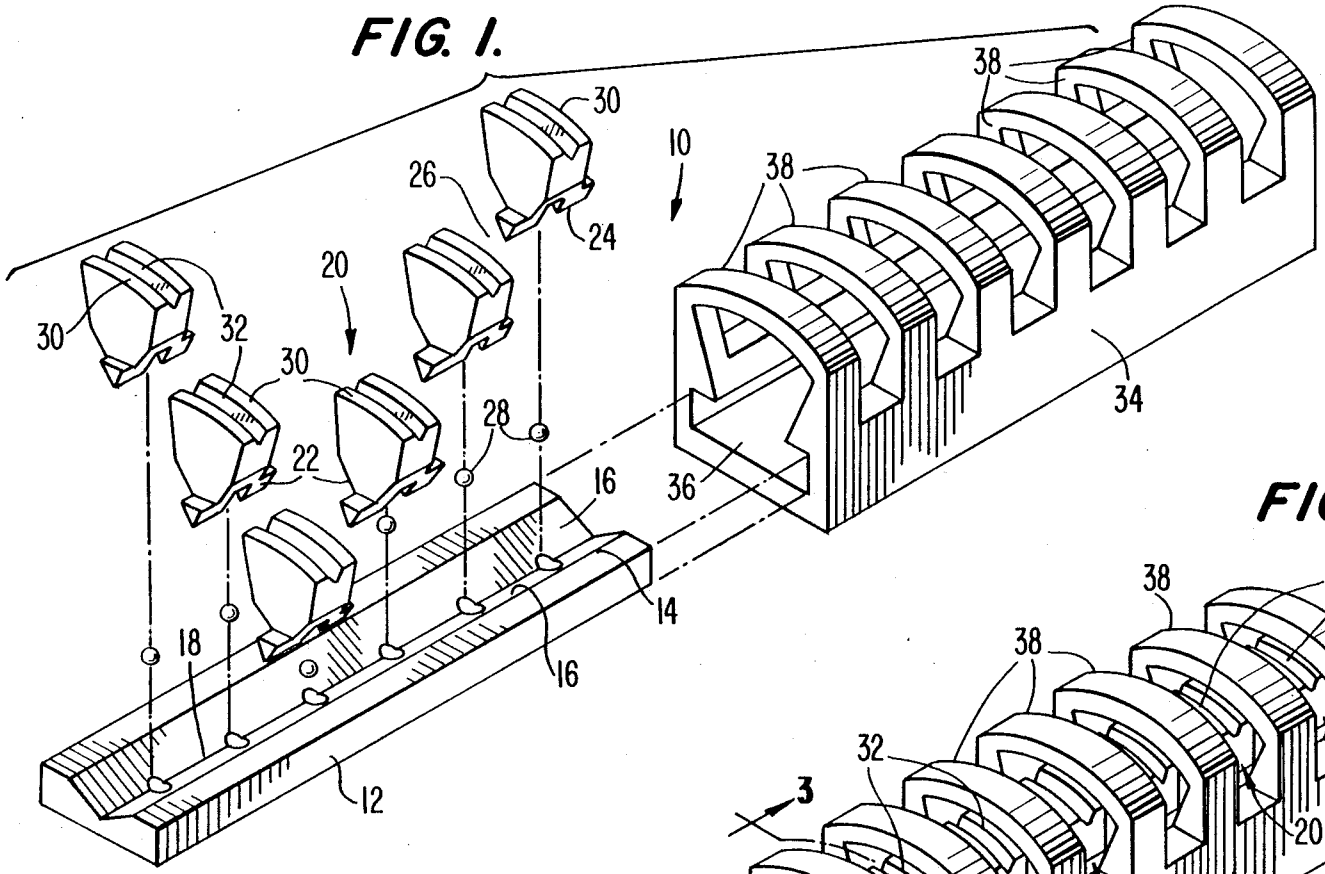
FIG. 1 is an exploded perspective view of a support for defining an end point of the vibrating portion of the strings of a stringed musical instrument according to the present invention.
Figure 2:
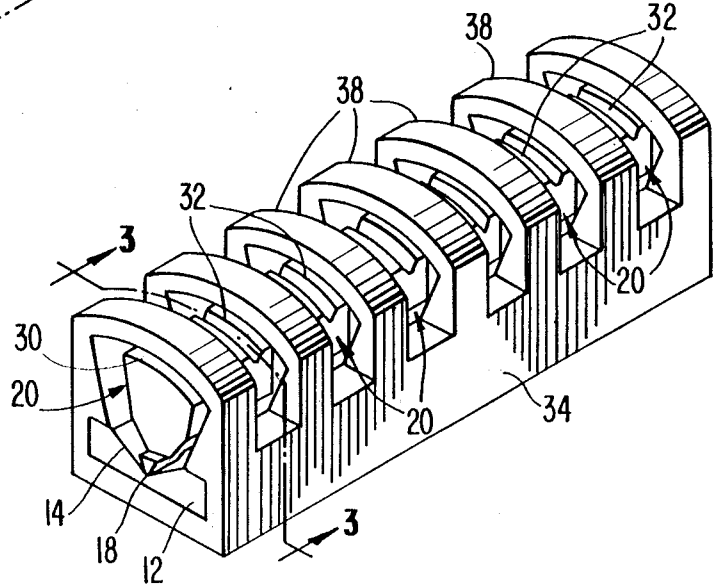
FIG. 2 is an assembled view of the support of FIG. 1.

In accordance with the present invention there is provided a support for defining an end point of the vibrating portion of the strings of a stringed musical instrument. As shown in FIG. 1, the support is shown generally at 10. Support 10 includes a base 12 which is a generally rectangularly-shaped block. A V-shaped slot 14 is formed in the upper surface of base 12 and traverses the entire length of base 12. Slot 14 has walls 16 which form an angle therebetween and converge to an apex line 18 formed in the bottom of the slot.

In accordance with the present invention the support further includes at least one rocker 20. Rocker 20 comprises a pie-shaped piece which has walls 22 which form an angle therebetween and converge to a knife edge 24. Knife edge 24 is complementary to and contacts apex line 18. Rocker 20 pivots on knife edge 24. The angle between walls 16 of base 12 is larger than the angle between walls 22 of rocker 20 to allow rocker 20 to rock in slot 14 while knife edge 24 engages apex line 18.

As shown in FIG. 1, knife edge 24 may include a plurality of knife-edge portions aligned in a direction along apex line 18. Each adjacent knife-edge portion 24 is separated by a space portion 26.

Preferably, the base includes means for engaging the rocker and for preventing movement of the rocker in a direction along the apex line. The means for engaging the rocker and for preventing movement of the rocker includes a ball bearing 28. As shown in FIG. 1, ball bearing 28 is mounted in base 12 and extends into space portion 26. As rocker 20 rocks, its movement in the direction along the apex line it is limited by ball bearing 28.

Figure 3:
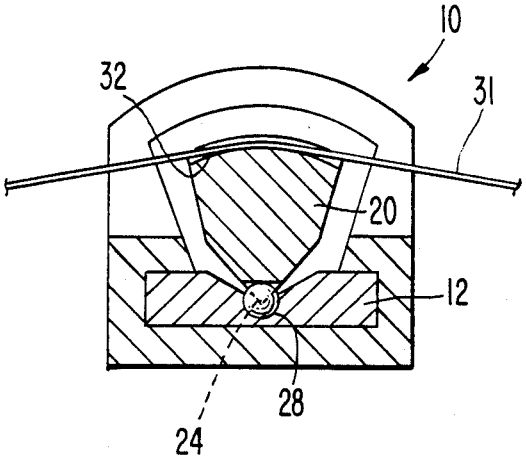
FIG. 3 is a sectional view of the device of FIG. 1 in a first position with a string.
Figure 4:
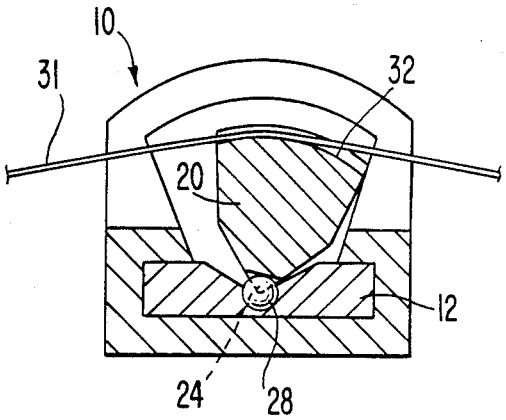
FIG. 4 is a sectional view of the device of FIG. 1 in a second position with a string.

In accordance with the present invention, the rocker has contacting means for contacting at least one of the strings and moving with the string in a direction along the length of the string while maintaining the end point of the vibrating portion of the string at a constant position relative to the base in the direction along the length of the string. As shown in FIG. 1, contacting means includes an arc-shaped surface 30 centered at knife edge 24. Arc-shaped surface 30 is formed by the upper peripheral surface of rocker 20. A groove 32 for receiving and positioning a string 31 is formed on arc-shaped surface 30 in the direction along the length of string 31. Groove 32 receives and positions string 31 such that, as string 31 moves, arc-shaped surface 30 moves with it in a direction along the length of string 31. As shown in FIGS. 3 and 4, since arc-shaped surface 30 moves with string 31, it maintains the end point of the vibrating portion of string 31 at a constant position relative to base 12 in the direction along the length of string 31.

The support preferably includes housing means for retaining the rocker in the slot of the base. As shown in FIG. 1 the housing means includes a housing 34 which retains rocker 20 in slot 14 of base 12. Preferably housing 34 is made of aluminum or any other suitable lightweight material. Housing 34 has a generally rectangular lower surface and includes a groove means for slidably receiving base 12. Groove means includes a groove 36 formed in a direction along apex line 18. The upper surface of the housing is arc-shaped to accommodate arc-shaped surface 30 of rocker 20. Slots 38 are formed in the upper surface of housing 34 in a direction along apex line 18. Slots 38 are aligned with groove 32 so that strings 31 are received and positioned by arc-shaped surface 30 and extend through housing 34.

Other embodiments of the present invention are possible. The support for defining an end point of the vibrating portion of the strings of a musical instrument could include a plurality of rockers, with each rocker engaging a plurality of strings. For example, a six-stringed guitar may use three rockers, each supporting two strings. Alternatively, a six-stringed guitar may use two rockers, each supporting three strings. In another embodiment, the rocker may include one unitary element which engages all six strings of the musical instrument.

Figure 5:
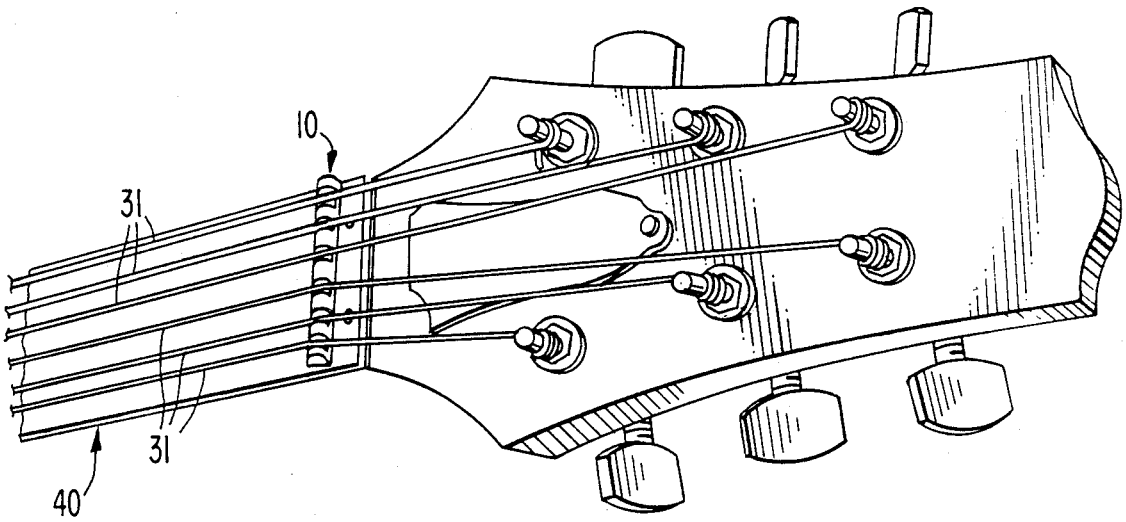
FIG. 5 is a perspective view of the device of FIG. 1 mounted on a guitar.

As shown in FIG. 5, support 10 is mounted on the neck of a musical instrument to form the nut of a guitar 40. Alternatively or additionally, although not shown, a similar support may be mounted on the body of the guitar to form the bridge of the guitar. As strings 31 of guitar 40 are tuned, they move relative to the body of guitar 40. Each arc-shaped surface 30 of rockers 20 contacts its respective string 31 and moves with string 31 in a direction along the length of string 31 as detailed in FIGS. 3 and 4. As arc-shaped surface 30 moves with string 31, it maintains the end point of the vibrating portion of string 31 at a constant position relative to base 12 in the direction along the length of string 31. This allows string 31 to return to their original pitch by returning to their original position relative to the bridge and nut after the tremolo has been activated and released.

Additional advantages and modifications will readily occur to those skilled in the art. The invention in its broader aspects is, therefore, not limited to the specific details, representative apparatus and illustrative example shown and described. Accordingly, departures may be made from such details without departing from the spirit or scope of the general inventive concept as defined by the appended claims and their equivalents.

In the claims:

1. A support for defining an end point of the vibrating portion of the strings of a stringed musical instrument comprising:

a base having a slot with walls which converge to an apex line; and at least one rocker having walls which converge to a knife edge complementary to the apex line, the angle between the walls of the base being larger than the angle between the walls of the rocker to allow the rocker to rock in the slot while the knife edge engages the apex line, said at least one rocker having contacting means for contacting at least one of said strings and moving with said at least one string in a direction along the length of said at least one string while maintaining the end point of the vibrating portion of said at least one string at a constant position relative to the base in the direction along the length of said at least one string.

2. The support of claim 1 wherein the contacting means of the rocker includes an arc-shaped surface centered at the knife edge.

3. The support of claim 1 wherein the knife edge includes a plurality of knife-edge portions aligned in a direction along the apex line and separated by a space portion.

4. The support of claim 1 wherein the base includes means for engaging the rocker and for preventing movement of the rocker in a direction along the apex line.

5. The support of claim 4 wherein the knife edge includes a plurality of knife-edge portions separated by a space portion and wherein the means for engaging the rocker and for preventing movement of the rocker includes a ball bearing which is mounted in the base and which extends into the space portion.

6. The support of claim 1 further including housing means for retaining the rocker in the slot of the base.

7. The support of claim 6 wherein the housing means includes a groove means for slideably receiving the base.

8. The support of claim 1 wherein the contacting means of the rocker includes a groove in the direction along the length of the string for receiving and positioning the string.

9. A support for defining an end point of the vibrating portion of the strings of a stringed musical instrument comprising:

a base having a slot with walls which converge to an apex line; and a plurality of rocker elements, each of said rocker elements for engaging a respective string on the musical instrument, each of said rocker elements having walls which converge to a knife edge complementary to the apex line, the angle between the walls of the base being larger than the angle between the walls of each of the rocker elements to allow the rocker elements to rock in the slot while the knife edge engages the apex line, each of the rocker elements having contacting means for contacting its respective string and moving with its respective string in a direction along the length of the string while maintaining the end point of the vibrating portion of its respective string at a constant position relative to the base in the direction along the length of its respective string.

10. The support of claim 9 wherein the contacting means of the rocker elements includes an arc-shaped surface centered at the knife edge.

11. The support of claim 9 wherein the knife edge includes a plurality of knife-edge portions aligned in a direction along the apex line and separated by a space portion.

12. The support of claim 9 wherein the base includes means for engaging the rocker elements and for preventing movement of the rocker elements in a direction along the apex line.

13. The support of claim 12 wherein the knife edge includes a plurality of knife-edge portions separated by a space portion and wherein the means for engaging the rocker elements and for preventing movement of the rocker elements includes a ball bearing which is mounted in the base and which extends into the space portion.

14. The support of claim 9 further including housing means for retaining the rocker in the slot of the base.

15. The support of claim 14 wherein the housing means includes a groove means for slideably receiving the base.

16. The support of claim 9 wherein the contacting means of the rocker elements includes a groove in the direction along the length of the respective string for receiving and positioning the string.

* * * * *

UNITED STATES PATENT AND TRADEMARK OFFICE

CERTIFICATE OF CORRECTION

PATENT NO. : 4,915,006

DATED : April 10, 1990

INVENTOR(S) : Ned Steinberger

It is certified that error appears in the above-identified patent and that said Letters Patent is hereby corrected as shown below:

On the title page:

In the Abstract, line 13, "vibrating position" is changed to --vibrating portion--.

Signed and Sealed this

Fourteenth Day of January, 1992

*Attest:*

HARRY F. MANBECK, JR.

*Attesting Officer*

*Commissioner of Patents and Trademarks*